US007487083B1

(12) United States Patent
Zhang

(10) Patent No.: US 7,487,083 B1
(45) Date of Patent: Feb. 3, 2009

(54) METHOD AND APPARATUS FOR DISCRIMINATING SPEECH FROM VOICE-BAND DATA IN A COMMUNICATION NETWORK

(75) Inventor: Peng Jie Zhang, Shanghai (CN)

(73) Assignee: Alcatel-Lucent USA Inc., Murray Hill, NJ (US)

( * ) Notice: Subject to any disclaimer, the term of this patent is extended or adjusted under 35 U.S.C. 154(b) by 1065 days.

(21) Appl. No.: 09/615,945

(22) Filed: Jul. 13, 2000

(51) Int. Cl.
*G10L 11/06* (2006.01)

(52) U.S. Cl. ..... 704/214; 704/215; 704/217

(58) Field of Classification Search ..... 704/214, 704/215, 217; 382/155; 455/226.1
See application file for complete search history.

(56) References Cited

U.S. PATENT DOCUMENTS 5,812,970 A * 9/1998 Chan et al. ..... 704/226
5,949,864 A * 9/1999 Cox ..... 379/189
5,960,388 A * 9/1999 Nishiguchi et al. ..... 704/208
6,018,706 A * 1/2000 Huang et al. ..... 704/207
6,229,848 B1 * 5/2001 Tanaka ..... 375/227
6,424,940 B1 * 7/2002 Agassy et al. ..... 704/219
6,438,518 B1 * 8/2002 Manjunath et al. ..... 704/219
6,574,321 B1 * 6/2003 Cox et al. ..... 379/189
6,708,146 B1 * 3/2004 Sewall et al. ..... 704/217
6,718,024 B1 * 4/2004 Heilmann et al. ..... 379/189

* cited by examiner

*Primary Examiner*—Michael N Opsasnick

(57) ABSTRACT

A method and an apparatus accurately discriminates between speech and voice-band data (VBD) in a communication network by calculating self similarity ratio (SSR) values, which indicate periodicity characteristics of an input signal segment, and/or autocorrelation coefficients, which indicate spectral characteristics of an input signal segment, to generate a speech/VBD discrimination result. In one implementation, the speech-VBD discriminating apparatus calculates both short-term delay and long-term delay SSR values to analyze the repetition rate of an input signal frame, thereby indicating whether the input signal frame has the periodicity characteristics of a typical speech signal or a VBD signal. The speech-VBD discriminating apparatus further calculates a plurality of short-term autocorrelation coefficients to determine the spectral envelope of an input frame, thereby facilitating accurate speech/VBD discrimination. According to one implementation of the present invention, the speech-VBD discriminating apparatus relies on sequential decision logic which improves classification performance by recognizing that changes from speech to VBD or vice versa in a communication medium are unlikely, and discounts discrimination results for relatively low-power signal portions which are more susceptible to errors to further improve discrimination accuracy.

21 Claims, 5 Drawing Sheets

METHOD AND APPARATUS FOR DISCRIMINATING SPEECH FROM VOICE-BAND DATA IN A COMMUNICATION NETWORK

BACKGROUND OF THE INVENTION

1. Technical Field

This invention relates to the field of communications, and more particularly to a method and an apparatus for discriminating speech from voice-band data in a communication network.

2. Description of Related Art

It is well known that the ability to discriminate between speech and voice-band data (VBD) signals, e.g., originating from a modem or facsimile machine, in a communication network can improve network efficiency and/or ensure Quality of Service requirements. For example, although channels of a conventional telephone network each carry 64 kbps, regardless of whether the channel is carrying speech or VBD, speech can be substantially compressed, e.g., to 8 kbps or 5.3 kbps, at an interface between the telephone network channel and a high-bandwidth integrated service communication system, such as at an ATM (Asynchronous Transfer Mode) trunking device or an IP-(Internet Protocol) telephone network gateway. Therefore, because the type of traffic received at such an interface device can dictate the signal processing performed, several techniques for discriminating between speech and VBD signals have previously been proposed. Such techniques conventionally rely on parameters such as zero-point crossing rates, signal extremas, high/low frequency power rates, and/or power variations between sequential signal segments to discriminate speech from VBD.

Although conventional techniques for discriminating between speech and VBD signals generally achieve low error rates for relatively low-speed VBD, the error rate for such techniques increases significantly for discrimination between speech and high-speed VBD transmissions, such as from V.32, V.32bis, V.34, and V.90 modems which utilize higher symbol rates and complex coding/modulation techniques and generate signals with many characteristics which are different than low-speed transmissions. For high-speed VBD, higher error rates occur because the distribution of many parameter values, such as zero-point crossing rates, signal extremas, and power variations, tend to overlap with corresponding speech parameter values.

SUMMARY OF THE INVENTION

The present invention is a method and an apparatus which accurately discriminates between speech and VBD in a communication network based on at least one of self similarity ratio (SSR) values, which indicate periodicity characteristics of an input signal segment, and autocorrelation coefficients, which indicate spectral characteristics of an input signal segment to generate a speech/VBD discrimination result.

Typically, voiced speech is characterized by relatively high energy content and periodicity, i.e., "pitch", unvoiced speech exhibits little or no periodicity, and transition regions which occur between voiced and unvoiced speech regions often have characteristics of both voiced and unvoiced speech. During normal transmission, high-speed VBD is scrambled, encoded, and modulated, thereby appearing as noise with no periodicity. Some low-speed VBD signals, such as control signals used during a start-up procedure, exhibit periodicity. The present invention discriminates between periodic speech and VBD signals by recognizing that periodic VBD signals will typically have a faster repetition rate than voiced speech, and calculating short-term delay and long-term delay SSR values to indicate the repetition rate of an input signal frame.

The present invention also recognizes that analyzing the periodicity characteristics of an input frame may not ensure accurate speech/VBD discrimination, and that the certain spectral characteristics of an input frame may reveal whether the input frame is speech or VBD. For example, the carrier frequency used by a typical modem/fax is within a narrow range, whereas speech is a non-stationary random signal which typically exhibits large variations in its power spectrum. The present invention calculates short-term autocorrelation coefficients to determine the spectral envelope of an input frame to facilitate accurate speech/VBD discrimination.

According to one implementation of the present invention, the speech/VBD discrimination technique of the present invention is implemented in a sequential decision logic algorithm which improves classification performance by recognizing that changes from speech to VBD or vice versa in a communication medium are unlikely. Therefore, after a predetermined number of frames have been classified as speech or VBD based on SSR values and/or autocorrelation coefficients, the sequential decision logic algorithm enters a "speech state" or a "VBD state" in which the speech/VBD discrimination output does not change unless a certain number of subsequent classification results indicate that the current decision state is erroneous. In one exemplary implementation of the present invention, the sequential decision logic algorithm discounts discrimination results for relatively low-power signal portions which are more susceptible to errors to further improve discrimination accuracy.

BRIEF DESCRIPTION OF THE DRAWINGS

Other aspects and advantages of the present invention will become apparent from the following detailed description and accompanying drawings, where.

DETAILED DESCRIPTION

Figure 1:
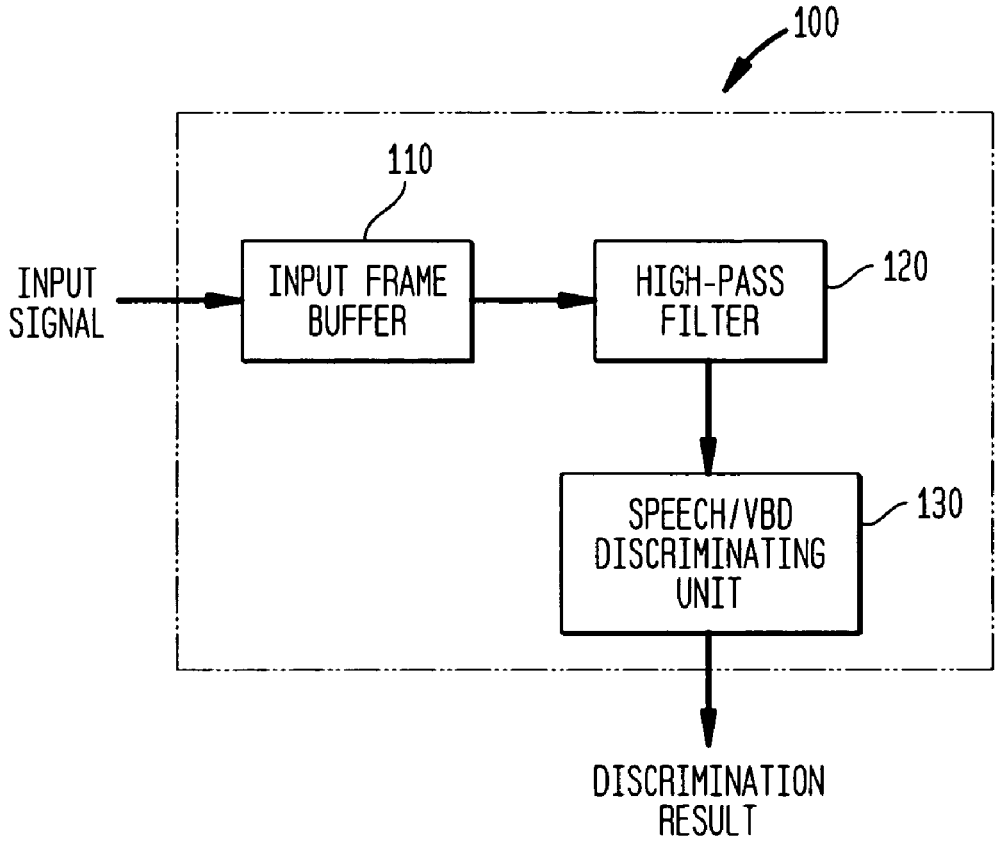
FIG. 1 is a general block diagram of an apparatus for discriminating speech from VBD signals in accordance with one embodiment of the present invention.

The present invention is a method and apparatus for accurately discriminating speech from VBD in a communication network. FIG. 1 is a general block diagram illustrating an exemplary speech/VBD discriminator 100 in accordance with one embodiment of the present invention which may be implemented in a network interface device, such as an ATM trunking device or an IP-telephone network gateway. As shown in FIG. 1, the speech/VBD discriminator 100 includes an input frame buffer 110, a high-pass filter 120, and a speech/VBD discriminating unit 130. It should be recognized that, although the general block diagram of FIG. 1 illustrates a plurality of discrete components, the VBD/discriminator 100 may be implemented in a variety of ways, such as in a software driven processor, e.g., a Digital Signal Processor (DSP), in programmable logic devices, in application specific integrated circuits, or in a combination of such devices.

The input frame buffer 110 receives an input signal, e.g., from a network line card which samples the signal from a conventional telephone network channel at an 8 kHz clock rate, to buffer frames of N consecutive speech samples per frame. Nominally, the input signal received by the input frame buffer has been sampled at an 8 kHz clock rate, frame size is in the range of 10 milliseconds (i.e., N=80 samples at a 8 kHz sampling rate) to 30 milliseconds (i.e., N=240 samples at a 8 kHz sampling rate), and a 16-bit linear binary word represents the amplitude of an input sample (i.e., an input sample is no more than $2^{15}$). The high-pass filter 120 filters each frame of N samples to remove DC components therefrom. Input frames are high-pass filtered because DC signal components have little useful information for speech/VBD discrimination, and may cause bias errors when computing the signal feature values discussed below. An exemplary filter transfer function represented in the z-transform domain, H(z), used by the high-pass filter 120 is represented as:

$$H(z) = \frac{1 - z^{-1}}{1 - \frac{127}{128} \cdot z^{-1}} \tag{1}$$

where $z^{-1}=e^{j\omega}$. The speech/VBD discriminating unit 130 receives the output of the high-pass filter 120, and performs speech/VBD discrimination in a manner described in more detail below.

Typically, speech includes voiced regions, which are characterized by relatively high energy content and periodicity (commonly referred to as "pitch"), unvoiced regions which have little or no periodicity, and transition regions which occur between voiced and unvoiced speech regions and, thus, often have characteristics of both voiced and unvoiced speech. During normal transmission, high speed VBD is scrambled, encoded, and modulated, thereby appearing as noise with no periodicity. Some low speed VBD signals, such as control signals used during a start-up procedure, exhibit periodicity.

The present invention recognizes that VBD signals which exhibit periodicity will typically have a faster repetition rate than voiced speech, and also recognizes that certain spectral characteristics can also be effectively used to discriminate VBD from speech. For example, the carrier frequency used by a typical modem/fax is within a narrow range, e.g., between 1 kHz and 3 kHz, such that the power spectrum of a VBD signal is centered on the carrier frequency, e.g., typically centered above 1 kHz. On the other hand, speech is a non-stationary random signal which typically exhibits large power spectrum variations. The present invention calculates short-term autocorrelation coefficients to determine the spectral characteristics of an input signal to aid speech/VBD discrimination. To enable speech/VBD discrimination in accordance with these principles, the speech/VBD discrimination unit 130 performs the calculations described below for each buffered and filtered frame of N samples.

The speech/VBD discriminating unit 130 calculates short-time power, Ps, of an input frame using a window of N samples by calculating:

$$P_s(n) = \frac{1}{N} \cdot \sum_{i=n\cdot(N-1)}^{n\cdot N-1} x(i) \cdot x(i), \tag{2}$$

where n is the frame number, and x(i) is the amplitude of sample i. The speech/VBD discriminating unit 130 also calculates SSR values to measure the similarity between sequential signal segments. More specifically, two separate SSR calculations are made for each frame to extract periodicity characteristics thereof. SSR1(n), representing SSR for a range of relatively small sample delays, is calculated as:

$$SSR_1(n)=\mathrm{Max}\{COL(n,j)\},\ 3 \leqq j \leqq 17, \tag{3}$$

where j is the sample delay, and COL(n,j) is calculated as:

$$COL(n, j) = \frac{\sum_{i=n\cdot(N-1)}^{n\cdot N-1} x(i) \cdot x(i-j)}{\sum_{i=n(N-1)}^{n\cdot N-1} x(i-j) \cdot x(i-j)} \tag{4}$$

$SSR_2(n)$, representing SSR for a range of relatively large sample delays, is calculated as:

$$SSR_2(n)=\mathrm{Max}\{COL(n,j)\},\ 18 \leqq j \leqq 143 \tag{5}$$

For voiced speech, the delay, i.e., the value of j, which results in the largest (max) SSR is the estimated pitch (or its multiple). The pitch of human voice is typically in the range of 2.225 milliseconds to 17.7 milliseconds or 18-122 samples in an 8 kHz sampled signal. Therefore, if SSR2(n) is larger than a certain threshold, this tends to indicate that the corresponding frame is voiced speech. If SSR1(n) is a large value, however, the input signal frame may be a non-speech stationary signal with a high repetition rate.

The speech/VBD discriminating unit 130 also calculates autocorrelation coefficients, which represent certain spectral characteristics of the frame of interest. Because an autocorrelation function of a signal is the inverse Fourier transform of its power spectrum, a short-term autocorrelation function, or low-delay autocorrelation coefficients, represents the spectral envelope of a frame. The present invention uses three autocorrelation coefficients, with 2, 3, and 4 sample delays respectively, to analyze spectral characteristics of a frame of interest. A normalized representation of autocorrelation for an input frame with a delay of k samples, Rkd(n), using a window of N consecutive samples, is represented by:

$$Rkd(n) = \frac{1}{N \cdot P_s(n)} \cdot \sum_{i=n\cdot(N-1)}^{n\cdot N-1} x(i) \cdot x(i-k). \tag{6}$$

To establish a relationship between the power spectrum of a signal and autocorrelation coefficients, it can be assumed that the input signal is a single tone represented as:

$$x(k)=A\cdot\sin(2\cdot\pi\cdot f\cdot k/f_s+\theta), \tag{7}$$

where $f_s$=8 kHz, and k=0, 1, 2 . . . . In this case, the autocorrelation coefficient with a delay of two samples, R2d, is:

$$R2d=\cos(4\cdot\pi\cdot f/f_s) \tag{8}$$

From equation (8), it can be seen that R2d will be negative for 1 kHz<f<3 kHz. Most VBD carrier frequencies lie in this range. If the input is a single tone, or a narrow-band signal with a power spectrum centered around 2 kHz, then R2d will be nearly −1. On the other hand, if the input signal is a tone or narrow band signal with a power spectrum centered around 0 kHz or 4 kHz, then R2d will be nearly +1.

According to equation (7), R3d and R4d can respectively be calculated as follows:

$$R3d=\cos(6\cdot\pi\cdot f/f_s); \quad (9)$$

$$R4d=\cos(8\cdot\pi\cdot f/f_s). \quad (10)$$

From equation (9), it can be seen that R3d is near −1 when the input signal is a narrow band signal with a power spectrum centered around 1.33 kHz, near 4 kHz, or both. If R4d is near −1, then the input signal should be a narrow band signal with a power spectrum centered around 1 kHz, 3 kHz, or both. Accordingly, R3d and R4d are effective parameters for discriminating single tone, multi-tone, and very low-speed VBD, i.e., such as used by many fax/modem systems, from speech.

As one practical example, the V.21, 300 bps, FSK duplex modem, uses different carrier frequencies (H, L) for different direction transmission. The lower channel, V.21 (L), has a nominal mean frequency of 1080 Hz with frequency deviation of +/−100 Hz. From equation (10), such a transmission results in:

$$f=1180\text{ Hz}:R4d=\cos(8\cdot1180\cdot\pi/80000)=-0.844;$$

$$f=980\text{ Hz}:R4d=\cos(8\cdot980\cdot\pi/80000)=-0.998.$$

Therefore, an R4d value of a V.21 (L) signal will be less than −0.80. The higher channel, V.21 (H), has a nominal mean frequency of 1750 Hz with frequency deviation of +/−100 Hz. From equation (8), R2d for a V.21 (H) signal will also be less than −0.8.

As another example, the V.22, 600 Hz symbol rate, QPSK/DPSK duplex modem uses a 1200 Hz carrier for its lower channel, and a 2400 Hz carrier and 1800 Hz guard tone for its higher channel. For a V22 (L) signal, from equation (9), we have:

$$f=1200\text{ Hz}, R3d=\cos(6\cdot1200\cdot\pi/8000)=-0.95.$$

Therefore, R3d will be near −1. R2d of V.22 (H) signal will also be less than −0.8.

Figure 2:
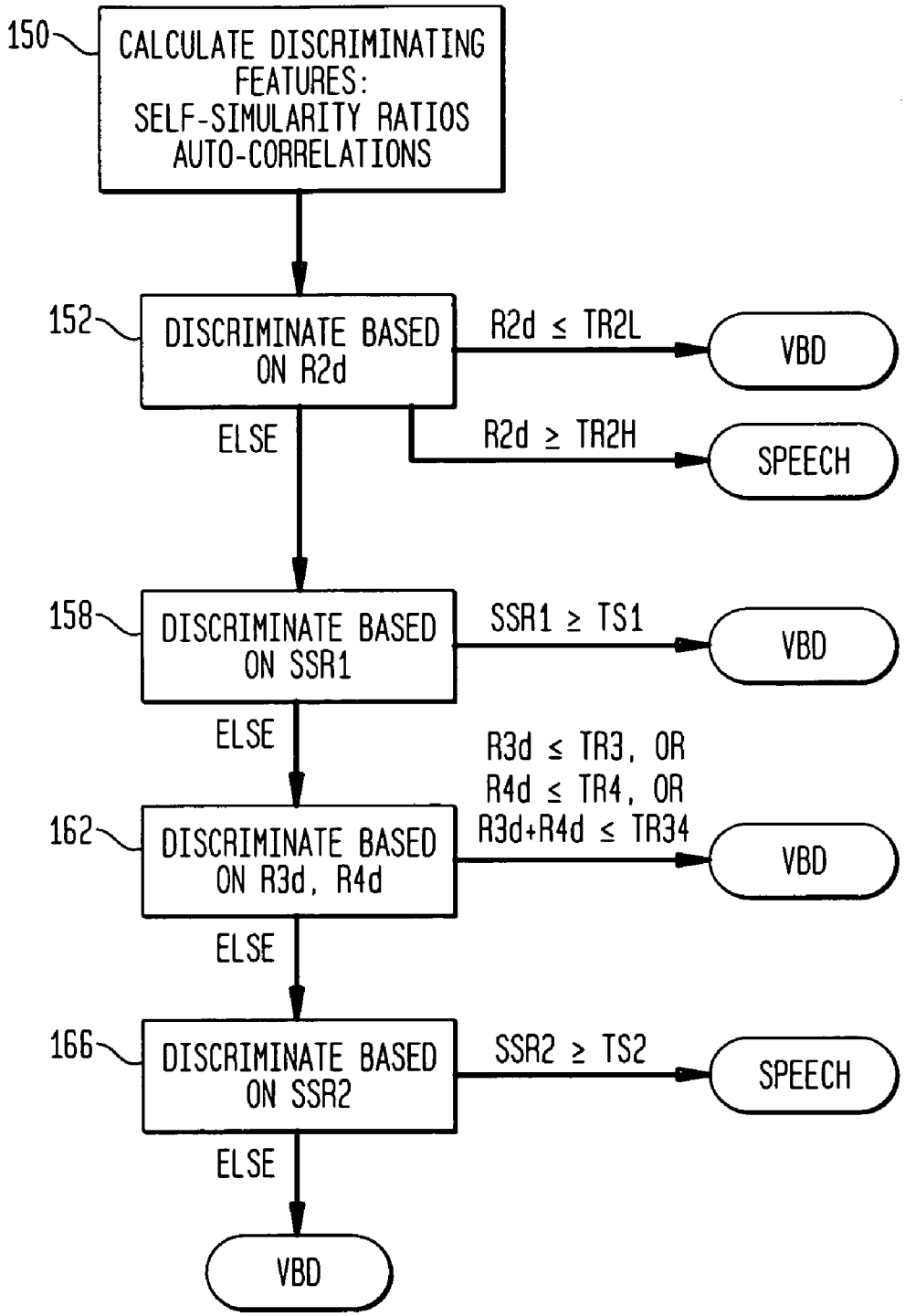
FIG. 2 is a flowchart illustrating speech/VBD discrimination based on SSR values and autocorrelation coefficients according to an embodiment of the present invention.

FIG. 2 illustrates an "raw decision" sequence for classifying a single input frame as being either speech or VBD using the calculated features discussed above. After calculating the Ps, SSR1, SSR2, R2d, R3d, and R4d values discussed above (step 150), the speech/VBD discriminating unit 130 initially attempts to classify the frame of interest as either speech or VBD based on R2d (step 152). Specifically, if R2d is less than or equal to a low threshold TR2L, e.g., TR2L=−0.75, the input frame is classified as VBD. If R2d is greater than or equal to a high threshold TR2H, e.g., TR2H=0.55, the input frame is classified as speech.

If R2d is between TR2L and TR2H, then the speech/VBD discriminating unit 130 next attempts to achieve a discrimination result based on SSR1 (step 158). Specifically, if SSR1 is greater than or equal to a first similarity threshold TS1, e.g., TS1=0.96, the input frame is classified as VBD. If SSR1 is less than TS1, the speech/VBD discriminating unit 130 next attempts to discriminate based on R3d and R4d (step 162). Specifically, the input frame is classified as VBD if R3d is less than or equal to a threshold TR3, e.g., TR3=−0.8, if R4d is less than or equal to a threshold TR4, e.g., TR4=−0.85, or if R3d+R4d is less than or equal to a threshold TR34, e.g., TR34=−1.37.

If none of these conditions are met, the speech/VBD discriminating unit 130 next attempts to discriminate based on SSR2 (step 166). Specifically, if SSR2 is greater than or equal to a threshold TS2, e.g., TS2=0.51, the input frame is classified as speech. If SSR2 is less than TS2, the input frame is classified as VBD.

Recognizing that once a frame is classified as speech or VBD, the next frame will probably have the same classification, the speech/VBD discrimination technique described above is implemented in a sequential decision logic algorithm in accordance with one embodiment of the present invention to improve decision reliability.

Figure 3A:
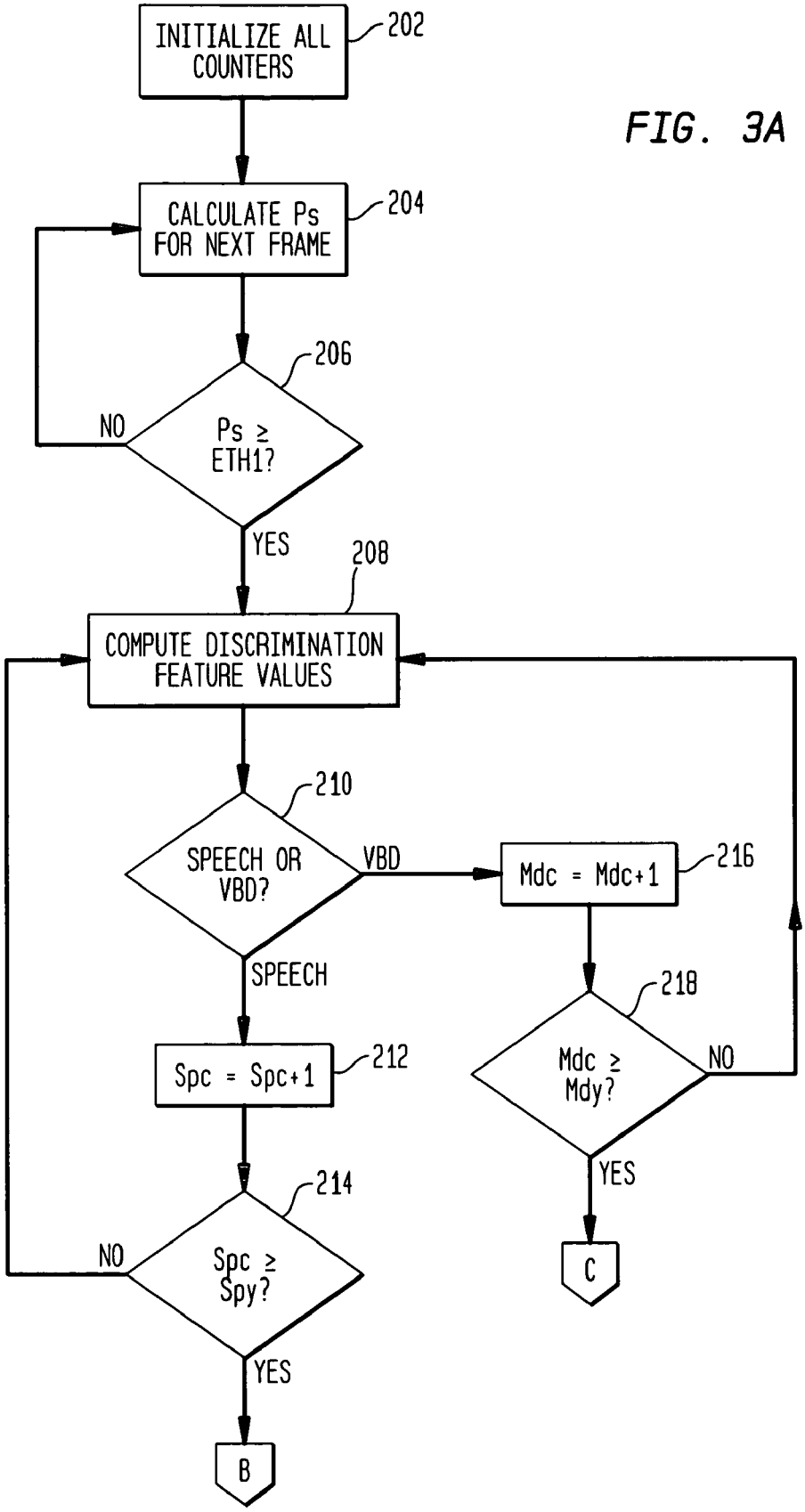
FIGS. 3A-3C are flowcharts illustrating a sequential decision logic algorithm for classifying input signal segments as either speech or VBD in accordance with an embodiment of the present invention.
Figure 3B:
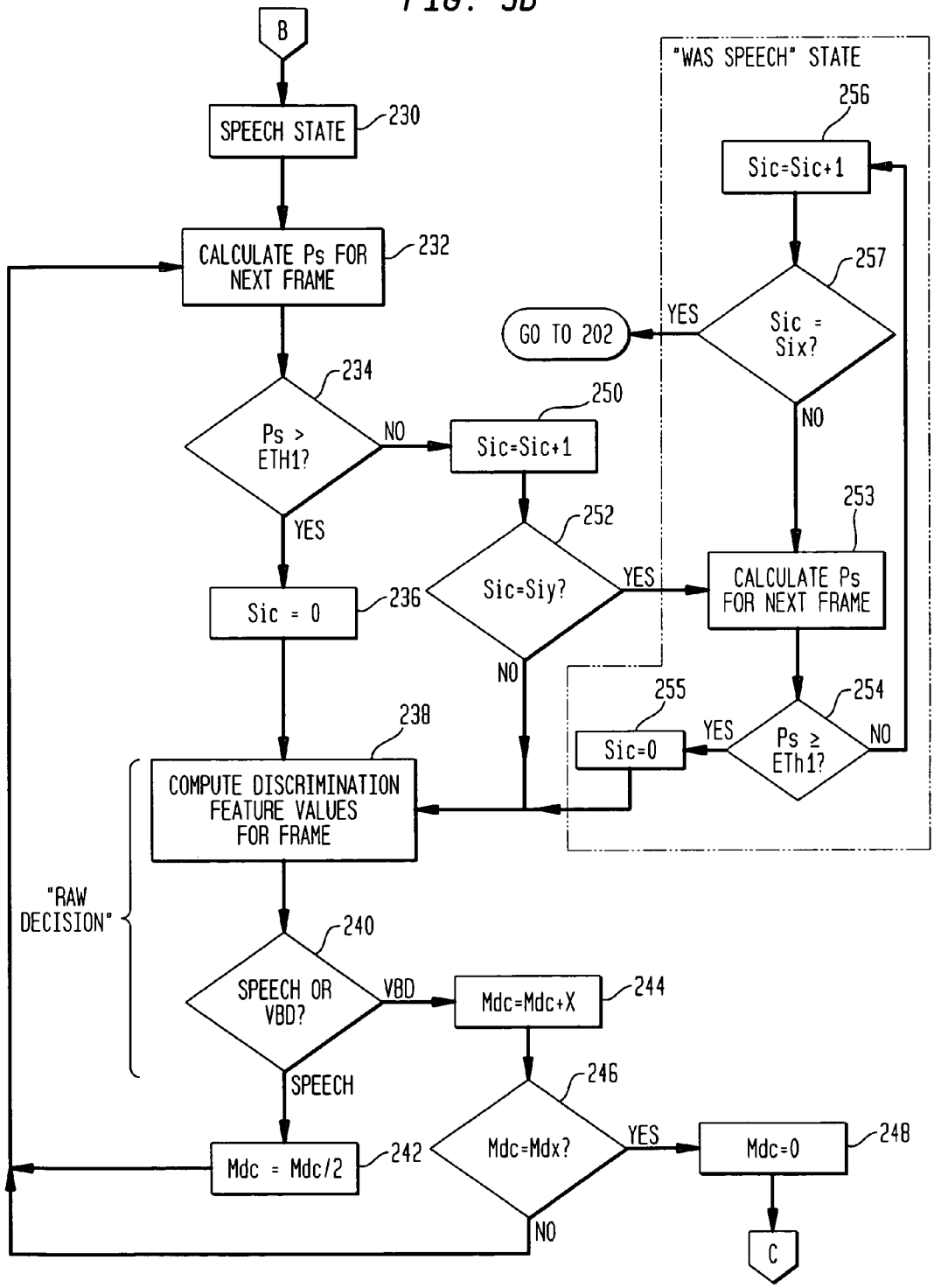
Figure 3C:
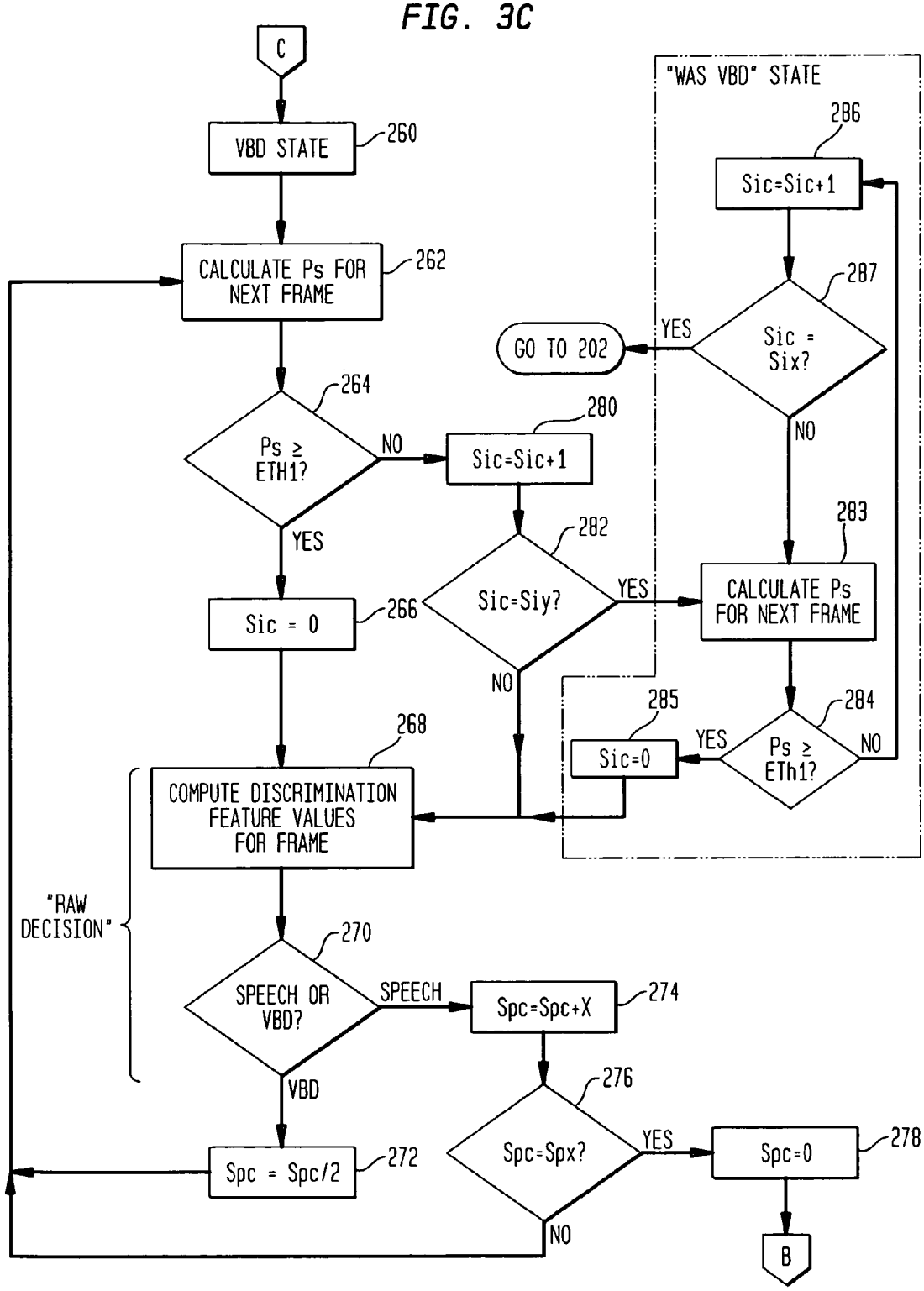

FIGS. 3A-3C are flowcharts which illustrate an exemplary sequential decision logic algorithm implemented by the speech/VBD discriminating unit 130 to discriminate speech and VBD. The sequential decision logic algorithm illustrated in FIGS. 3A-3C essentially has six states: (1) an initialization state; (2) a determination state in which individual input frames are classified as being either speech or VBD; (3) a speech state in which the classification result remains speech until subsequent classification results indicate that the speech state is erroneous; (4) a "was speech" state in which a period of low-power occurs after entering the speech state; (5) a VBD state in which the classification result remains VBD until subsequent classification results indicate the VBD state is erroneous; and (6) a "was VBD" state in which a period of low-power occurs after entering the VBD state. The significance of these classification states will become more apparent from the following description.

Referring to FIG. 3A, during an initialization step, each counter used in the sequential decision algorithm is set to 0 (step 202). Next, the discriminating unit 130 calculates Ps for a frame of interest (step 204) and determines whether Ps is greater than or equal to an energy threshold ETh1 (step 206). When Ps is less than ETh1, the discriminating unit does not attempt to determine whether the frame is speech or VBD, and instead returns to step 204 to calculate the Ps for the next frame. In other words, the discriminating unit 130 does not initially attempt to classify input frames as speech or VBD until Ps reaches ETh1. The sequential decision logic algorithm remains in an initialization state until Ps reaches ETh1.

When the discriminating unit 130 determines that Ps is greater than or equal to ETh1, the sequential decision logic algorithm enters a determination state in which the speech/VBD discriminating unit 130 calculates discrimination feature values for the frame of interest (step 208) and decides whether these discrimination feature values indicate that the frame of interest is speech or VBD (step 210). In other words, the discriminating unit 130 executes the raw decision logic discussed above with reference to FIG. 2 to classify the frame of interest as speech or VBD. When the frame of interest is classified as speech, a speech counter Spc is incremented by 1 (step 212), and Spc is compared to a speech count threshold Spy, e.g., Spy=1 (step 214). If Spc is less than Spy, the sequential decision logic remains in the determination state and the discriminating unit 130 computes the discrimination feature values for the next input frame (step 208). If Spc is at least equal to Spy, the sequential decision logic enters the speech state, which is described below with reference to FIG. 3B.

If, at step 210, the input frame is classified as VBD, a VBD counter Mdc is incremented by 1 (step 216), and Mdc is compared to a VBD count threshold Mdy, e.g., Mdy=4. If Mdc is less than Mdy, the sequential decision logic remains in the determination state, and the discriminating unit 130 computes the discrimination feature values for the next frame (step 208). If Mdc is at least equal to Mdy, the sequential decision logic enters the VBD state, which is discussed in detail below with reference to FIG. 3C. In accordance with the sequential decision logic shown in FIG. 3B, after a predetermined number of frames have been classified as speech/VBD based on SSR and/or autocorrelation coefficient values so that the sequential decision logic algorithm enters the speech/VBD state, speech/VBD discrimination output does not change unless a certain number of subsequent classification results indicate that the speech/VBD state is erroneous.

Referring to FIG. 3B, when the sequential decision logic enters the speech state (step 230), Ps is calculated for the next frame (step 204) and compared with the energy threshold ETh1 (step 234). If Ps is at least equal to ETh1, a silence counter Sic is set equal to 0 (step 236), and the speech/VBD discriminating unit 130 calculates discrimination feature values for the next frame (step 238) so that the input frame can be classified as speech or VBD (step 240), i.e., "raw decision" is performed. If the input frame is classified as speech at step 240, the VBD counter Mdc is divided by 2 (step 242), the sequential decision logic remains in the speech state, and the classification sequence returns to step 232 so that the discriminating unit 130 calculates Ps for the next frame. If the input frame is recognized as VBD at step 240, the VBD counter Mdc is incremented by a "power-compensated" increment x (described in detail below) (step 244), and Mdc is compared with the VBD state-change threshold Mdx, e.g., Mdx=8 (step 246). If Mdc is not at least equal to Mdx, the sequential decision logic remains in the speech state, and the decision sequence returns to step 232 so that the speech/VBD discriminating unit 130 calculates Ps for the next frame. When, however, Mdc is at least equal to Mdx, the VBD counter Mdc is reset to 0 (step 248), and the sequential decision logic switches to the VBD state.

When the speech/VBD discriminating unit 130 determines at step 234 that Ps is less than ETh1, the silence counter Sic is incremented by 1 (step 250) and compared to a silence counter threshold Siy, e.g., Siy=8, (step 252). If Sic has not reached Siy, the sequential decision logic remains in the speech state, and proceeds to step 238 so that the discriminating unit 130 computes discrimination values for the frame of interest. When Sic reaches Siy, however, the sequential decision logic enters a "was speech" state which will next be described with reference to flow diagram blocks 253-257. During the "was speech" state, the discriminating unit 130 initially calculates Ps for the next frame (step 253), and compares Ps with the energy threshold ETh1 (step 254). If Ps is greater than or equal to ETh1, the silence counter Sic is reset to 0 (step 255) and the sequential decision logic returns to speech state step 238. When the discriminating unit 130 determines that Ps is less than ETh1 at step 254, the silence counter Sic is incremented by 1 (step 256) and Sic is compared to a second silence counter threshold Six (step 257), e.g., Six=200. If Sic has not reached Six, the sequential decision logic remains in the "was speech" state, and Ps is calculated for the next frame at step 253. When Sic reaches Six, however, the sequential decision logic returns to its initialization state at step 202, i.e., reset occurs.

Referring next to FIG. 3C, it can be seen that the sequential decision logic operates during the VBD state in a similar manner to the speech state described above with regard to FIG. 3B. Specifically, after entering the VBD state (step 260) based on the determination at step 218 or step 246, the discriminating unit 130 calculates Ps for the next frame (step 262) and compares Ps with the energy threshold ETh1 (step 264). If Ps is greater than or equal to ETh1, the silence counter Sic is set equal to 0 (step 266), and the discriminating unit 130 computes the discrimination feature values for the frame of interest (step 268) so that the discriminating unit 130 determines whether the frame of interest is speech or VBD based on the "raw decision" logic of FIG. 2 (step 270). If the discriminating unit 130 determines at step 270 that the frame of interest is VBD, the speech counter Spc is divided by two (step 272), the sequential decision logic remains in the VBD state, and Ps is calculated for the next frame (step 262). If the discriminating unit 130 determines at step 270 that the frame of interest is speech, the speech counter Spc is incremented by a "power-compensated" increment x (step 274), and Spc is compared with a speech counter threshold Spx, e.g., Spx=4 (step 276). If Spc is not at least equal to Spx, the sequential decision logic remains in the VBD state and returns to step 262 so that the discriminating unit 130 calculates Ps for the next frame. If Spc is determined to be at least equal to Spx at step 276, the speech counter Spc is reset to 0 (step 278) and the sequential decision logic enters the speech state discussed above with reference to FIG. 3B.

When Ps is less than ETh1 at step 264, the silence counter Sic is incremented by 1 (step 280) and compared with the silence counter threshold Siy (step 282). If Sic is not at least equal to Siy, the sequential decision logic remains in the VBD state and proceeds to step 268 to compute discrimination feature values for the frame of interest. When, however, Sic reaches Siy at step 282, the sequential decision logic enters a "was VBD" state which is next described with reference to blocks 283-287 shown in FIG. 3C.

Specifically, the discriminating unit 130 calculates Ps for the next frame (step 283) and compares Ps with ETh1 (step 284). If Ps is greater than or equal to ETh1, the silence counter Sic is reset to 0 (step 285), and the sequential decision logic returns to step 268 of the VBD state to compute discrimination feature values for the frame of interest. When Ps is less than ETh1 at step 284, the silence counter Sic is incremented by 1 (step 286) and Sic is compared with the second silence counter threshold Six (step 287). When Sic is determined to be less than Six at step 287, the sequential decision logic remains in the "was VBD" state and Ps is calculated for the next frame (step 283). When Sic reaches Six at step 287, however, the sequential decision logic returns to the initialization state of step 202.

Regarding to the "power-compensated" increment x discussed above with reference to the speech state and VBD state decision logic, the present invention recognizes that discrimination between speech and VBD is more prone to errors for relatively low-power signal portions. For speech, a low-power signal portion may be unvoiced speech or gaps between speech. For VBD, a low-power portion may represent gaps between transmissions, or the waiting period during a handshake procedure. These signal portions are more prone to be influenced by noise and cross-talk because lower signal power results in a lower signal-to-noise ratio. Therefore, the "power compensated" increment x used to control when the sequential decision logic switches from the speech state to the VBD state, and vice versa, is a function of Ps. For a relatively low Ps, a small x is assigned. Otherwise, a larger x is used. Additional an adaptive power threshold, ETh2, is used to determine whether a relatively large or small value of x should be used. ETh2 is calculated as follows:

$$P_{max}=\max(\alpha\cdot P_{max},Ps(n))$$

$$ETh2=\beta\cdot P_{max} \tag{11}$$

$$\mathrm{ETh2}\in[\mathrm{Ebnd},\mathrm{Ebup}],$$

where Ebup and Ebnd are the upper and lower boundaries of ETh2 respectively. Ebnd can be as small as or a multiple of ETh1, e.g., Ebnd=10·ETh1, and Ebup can, e.g., $=1.2\cdot10^7$. The symbol $\alpha$ represents a constant which is near 1, e.g., $\alpha=0.995$, and $\beta$ is also a constant which can be between 1/50 to 1/10, e.g., $\beta=1/12$. Pmax is the run-time estimation of the peak power of the signal.

Using ETh2, the "power compensated" variable x can be determined as follows:

```
If Ps<ETh1:x=0;

Else if Ps<ETh2:x=γ;

Else x=1                                    (12)
```

where $\gamma$ is a constant in the range of [0.1, 0.5], e.g., $\gamma=0.2$. It should be realized that the evaluation criteria of the above-described discrimination technique can be altered for different applications. For example, some of the parameters discussed above can be adjusted depending on the requirements of the individual system, for example if the system requires a fast decision, or an extremely low misclassification ratio.

The foregoing merely illustrates the principles of the invention. It will be appreciated that those skilled in the art will be able to devise various arrangements which, although not explicitly described or shown herein, embody the principles of the invention and are thus within the spirit and scope.

What is claimed is:

1. A method of discriminating speech from voice-band data in a communication network, comprising:

calculating a self similarity ratio value, representing a periodicity characteristic, and an autocorrelation coefficient value, representing a spectral characteristic, for an input signal segment, wherein calculating the self similarity ratio value includes calculating a plurality of different self similarity ratio values and selecting the highest one of the plurality of different self similarity ratio values as the calculated self similarity ratio value; and determining whether said input signal segment is speech or voice-band data based on said at least one of said self similarity value and said autocorrelation coefficient value.

2. The invention as defined in claim 1, wherein said input signal segment is a frame of N samples.

3. The method of claim 1, wherein said self similarity ratio is calculated based on more than one sample.

4. The invention as defined in claim 1, wherein said calculating step calculates a first self similarity ratio value, corresponding to a first sample delay, as a first periodicity characteristic value; and said determining step determines that said input signal segment is voice-band data if said first self similarity ratio value is greater than a first similarity threshold.

5. The invention as defined in claim 4, wherein said calculating step calculates a second self similarity ratio value, corresponding to a second sample delay, as a second periodicity characteristic value, said second sample delay being greater than said first sample delay; and said determining step determines that said input signal segment is speech if said second self similarity ratio value is greater than a second similarity threshold.

6. The invention as defined in 1, wherein said calculating step calculates a first autocorrelation coefficient as a first spectral characteristic value; and said determining step determines that said input signal segment is voice-band data if said first autocorrelation coefficient is less than a first autocorrelation threshold, and that said input signal segment is speech if said first autocorrelation coefficient is greater than a second autocorrelation threshold, said second autocorrelation threshold being greater than said first autocorrelation threshold.

7. The invention as defined in claim 6, wherein said calculating step calculates second and third autocorrelation coefficients as second and third spectral characteristic values respectively, and said determining step determines that said input signal segment is voice-band data if said second autocorrelation coefficient is less than a third autocorrelation threshold or said third autocorrelation coefficient is less than a fourth autocorrelation threshold.

8. The invention as defined in claim 7, wherein said determining step determines that said input signal segment is voice-band data if a sum of said second autocorrelation coefficient and said third autocorrelation coefficient is less than a fifth autocorrelation threshold.

9. The invention as defined in claim 1, wherein said calculating and determining steps are performed for a plurality of input signal segments in accordance with a sequential decision logic sequence which designates input signal segments as speech during a speech state and designates input signal segments as voice-band data during a voice-band data state.

10. The invention as defined in claim 9, wherein said sequential decision logic sequence switches from said speech state to said voice-band data state when results of said determining step for a plurality of input signal segments indicate that said speech state is erroneous, and said sequential decision logic sequence switches from said voice-band data state to said speech state when results of said determining step for a plurality of input signal segments indicate that said voice-band data state is erroneous.

11. The invention as defined in claim 9, wherein results of said determining step are weighted based on energy content of the corresponding input signal segment so that determination results for low energy input signal segments are given relatively low weight when determining whether to switch from said speech state to said voice-band data state or from said voice-band data state to said speech state.

12. An apparatus for discriminating speech from voice-band data in a communication network, comprising:

calculating means for calculating a self similarity ratio value, representing a periodicity characteristic, and an autocorrelation coefficient value, representing a spectral characteristic, for an input signal segment, wherein calculating the self similarity ratio value includes calculating a plurality of different self similarity ratio values and selecting the highest one of the plurality of different self similarity ratio values as the calculated self similarity ratio value; and determining means for determining whether said input signal segment is speech or voice-band data based on said at least one of said self similarity value and said autocorrelation coefficient value.

13. The invention as defined in claim 12, wherein said input signal segment is a frame of N samples.

14. The invention as defined in claim 12, wherein said calculating means calculates a first self similarity ratio value, corresponding to a first sample delay, as a first periodicity characteristic value; and said determining means determines that said input signal segment is voice-band data if said first self similarity ratio value is greater than a first similarity threshold.

15. The invention as defined in claim 14, wherein said calculating means calculates a second self similarity ratio value, corresponding to a second sample delay, as a second periodicity characteristic value, said second sample delay being greater than said first sample delay; and said determining means determines that said input signal segment is speech if said second self similarity ratio value is greater than a second similarity threshold.

16. The invention as defined in 12, wherein said calculating means calculates a first autocorrelation coefficient as a first spectral characteristic value; and said determining means determines that said input signal segment is voice-band data if said first autocorrelation coefficient is less than a first autocorrelation threshold, and that said input signal segment is speech if said first autocorrelation coefficient is greater than a second autocorrelation threshold, said second autocorrelation threshold being greater than said first autocorrelation threshold.

17. The invention as defined in claim 16, wherein said calculating means calculates second and third autocorrelation coefficients as second and third spectral characteristic values respectively, and said determining means determines that said input signal segment is voice-band data if said second autocorrelation coefficient is less than a third autocorrelation threshold or said third autocorrelation coefficient is less than a fourth autocorrelation threshold.

18. The invention as defined in claim 17, wherein said determining means determines that said input signal segment is voice-band data if a sum of said second autocorrelation coefficient and said third autocorrelation coefficient is less than a fifth autocorrelation threshold.

19. The invention as defined in claim 12, wherein said apparatus classifies a plurality of input signal segments as being either speech or voice-band data in accordance with a sequential decision logic sequence which designates input signal segments as speech during a speech state and designates input signal segments as voice-band data during a voice-band data state.

20. The invention as defined in claim 19, wherein said apparatus, in accordance with said sequential decision logic sequence, switches from said speech state to said voice-band data state when results of said determining means for a plurality of input signal segments indicate that said speech state is erroneous, and said apparatus, in accordance with said sequential decision logic sequence, switches from said voice-band data state to said speech state when results of said determining means for a plurality of input signal segments indicate that said voice-band state is erroneous.

21. The invention as defined in claim 19, wherein said apparatus weights results of said determining means based on energy content of the corresponding input signal segment so that determination results for low energy input signal segments are given relatively low weight when said apparatus judges whether to switch from said speech state to said voice-band data state or from said voice-band data state to said speech state.

* * * * *